US008468840B2

(12) United States Patent
Burgers et al.

(10) Patent No.: US 8,468,840 B2
(45) Date of Patent: Jun. 25, 2013

(54) METHOD AND APPARATUS FOR SIMULTANEOUS GAS SUPPLY FROM BULK SPECIALTY GAS SUPPLY SYSTEMS

(75) Inventors: Kenneth Leroy Burgers, East Amherst, NY (US); Stephen Chesters, Allen, TX (US); Justin Cole Germond, Amherst, NY (US); Edward Pryor, San Antonio, TX (US); Jack W. Erb, Fair Oaks Ranch, TX (US); Keith Randall Pace, East Amherst, NY (US); Brian Michael Meredith, North Tonawanda, NY (US)

(73) Assignee: Praxair Technology, Danbury, CT (US)

( * ) Notice: Subject to any disclaimer, the term of this patent is extended or adjusted under 35 U.S.C. 154(b) by 833 days.

(21) Appl. No.: 12/178,936

(22) Filed: Jul. 24, 2008

(65) Prior Publication Data

US 2010/0018249 A1 Jan. 28, 2010

(51) Int. Cl.

| | |
|---|---|
| ***F17C 7/04*** | (2006.01) |
| ***F17C 7/02*** | (2006.01) |
| ***E03B 11/00*** | (2006.01) |

(52) U.S. Cl.

USPC ..... 62/48.1; 62/50.1; 62/657; 137/572

(58) Field of Classification Search

USPC .... 62/48.1, 721, 6, 158; 700/240–242; 222/3, 222/6, 58

See application file for complete search history.

(56) References Cited

U.S. PATENT DOCUMENTS

| | | | | |
|---|---|---|---|---|
| 2,552,783 | A * | 5/1951 | Harper | 222/3 |
| 4,202,180 | A * | 5/1980 | Cox | 62/48.1 |
| 5,339,642 | A * | 8/1994 | Laukhuf | 62/77 |
| 5,690,743 | A | 11/1997 | Murakami et al. | |
| 5,761,911 | A * | 6/1998 | Jurcik et al. | 62/50.2 |
| 5,764,522 | A * | 6/1998 | Shalev | 700/240 |
| 5,894,742 | A | 4/1999 | Friedt | |
| 6,098,843 | A * | 8/2000 | Soberanis et al. | 222/53 |
| 6,134,805 | A | 10/2000 | Chowdhury et al. | |
| 6,199,384 | B1 * | 3/2001 | Udischas et al. | 62/48.1 |
| 6,363,728 | B1 * | 4/2002 | Udischas et al. | 62/48.1 |
| 6,581,412 | B2 | 6/2003 | Pant et al. | |
| 6,614,009 | B2 | 9/2003 | Gershtein et al. | |
| 6,637,212 | B2 | 10/2003 | Torres, Jr. et al. | |
| 6,643,951 | B1 | 11/2003 | Chowdhury et al. | |
| 7,069,730 | B2 * | 7/2006 | Emmer et al. | 62/50.1 |
| 2004/0035533 | A1 | 2/2004 | Isom et al. | |
| 2005/0132720 | A1 * | 6/2005 | Rameau et al. | 62/50.1 |
| 2006/0231144 | A1 * | 10/2006 | Schwan et al. | 137/572 |
| 2007/0007879 | A1 | 1/2007 | Bergman, Jr. et al. | |
| 2007/0204908 | A1 * | 9/2007 | Fogelman et al. | 137/12 |
| 2008/0282709 | A1 * | 11/2008 | Sugawara | 62/48.1 |

FOREIGN PATENT DOCUMENTS

| | | | |
|---|---|---|---|
| JP | 11226386 A | * | 8/1999 |
| WO | WO03089853 | * | 10/2003 |
| WO | WO03089853 A1 | * | 10/2003 |
| WO | WO2008/042710 A2 | | 4/2008 |

OTHER PUBLICATIONS

English translation of the Japanese patent JP11226386.*

* cited by examiner

*Primary Examiner* — Mohammad M Ali
*Assistant Examiner* — Henry Crenshaw
(74) *Attorney, Agent, or Firm* — Nilay S. Dalal; Iurie A. Schwartz

(57) ABSTRACT

Methods, apparatuses and systems are disclosed for supplying gas from a multi-container Bulk Specialty Gases Supply System wherein at least one process parameter is automatically monitored to prevent over-filling of at least a first and second container without operator intervention.

20 Claims, 9 Drawing Sheets

METHOD AND APPARATUS FOR SIMULTANEOUS GAS SUPPLY FROM BULK SPECIALTY GAS SUPPLY SYSTEMS

FIELD OF THE INVENTION

Embodiments of the present invention are directed generally to the field of high flow rate gas delivery systems. More specifically, embodiments of the present invention are directed to the methods, apparatuses and systems for high flow bulk specialty gas supply systems (BSGS systems) that allow for multiple gas deliveries (source containers) of any combination to be manifolded together with improved safety monitoring and performance.

BACKGROUND OF THE INVENTION

Known high flow BSGS systems confront significant problems relative to backflow detection, container depletion, and the recurrent need for system redesigns when multiple gases with different physical properties are desired. In a high flow BSGS system that seeks to reliably supply ammonia vapor from multiple gas containers at the same time, poor system designs can lead to problems. For example, backflow of ammonia from one container into another can result in overfilling and possible subsequent over-pressurization. Further, containers may not become depleted at the same time due to unequal withdrawal rates from the containers. This results in wasted product due to excessive amounts of "heel". Still further, excessive redesign/retrofit is required for all the various potential combinations of types of BSGS gases, BSGS containers including tonners, low pressure drums, and iso-containers (ISOs), which may be connected to any of several BSGS gas panels.

Further, manifolding containers allows for ultra high vapor draws from liquefied gas sources without the need for massive and costly bulk supply vessels, thus achieving substantially equivalent flows as with ISOs.

The known systems concerned with gases, particularly ammonia, address, for example, methods to provide heat to the bulk supply sources. These methods are generally intended to either improve the flow capacity of the system or improve the purity of the ammonia product. Other known methods address attempts to impact the flow capacity of a system by using liquid withdrawal of ammonia with subsequent vaporization taking place in a heat exchanger that is external to the bulk container, or improving the purity of the ammonia product.

However, no known systems or methods address the need to avoid backflow, (with or without operator intervention), from one container to another when supplying vapor from containers of gases. Backflow can result in a situation where a container may become hydraulically full of liquefied product gas. When heat is applied to a container in this condition, the results can include undesirable activation of container pressure relief devices and/or over-pressurization of the container, depending on the type of container and the type of relief device employed.

The known "heated room" technique claims to avoid the backflow issue by not using heaters directly applied to the containers and, presumably, by designing a flow manifold that collects the gases from the multiple sources, such that the flow resistance is allegedly similar for each container. However, this technique is characterized by very low heat transfer rates for individual containers and, subsequently, very low steady state gas flow capacities per container. In addition, for applications with high flow rates, large numbers of containers are required.

Therefore, there are no known methods regarding the simultaneous gas feed and supply from multiple BSGS sources that solve the present problems known to exist in the field.

SUMMARY OF THE INVENTION

Embodiments of the present invention differ significantly from known BSGS systems, and include a universal combined source header for joining the process flows from the multiple containers in combination with a control method to detect and prevent backflow from one container to another, and a control method to automatically equalize the gas withdrawal from the BSGS containers so that they become depleted at approximately the same time.

In a further embodiment, the present invention is directed to a method for supplying gas from a multi-container system comprising the steps of providing a multi-container system comprising at least a first and second container, monitoring at least one process parameter of the multi-container system, said parameter selected from the group consisting of pressure, flow rate, temperature, liquid level, and container weight, preventing overfilling of a first or second container without operator intervention; and providing a connectivity between system components, said components selected from the group consisting of gas sources, gas source containers, gas supply panels, and combinations thereof, etc.

In a still further embodiment, the present invention is directed to an improved method and system to supply ammonia vapor from a multi-container BSGS system resulting in a safe and reliable operation. One aspect is monitoring process parameters such as pressure, liquid level, flow rate and container weight as ammonia vapor is drawn and taking process control actions to prevent overfilling of a container by events, such as, for example, backflow, etc. Another aspect is a method to supply ammonia vapor from two or more containers such that the containers become depleted at approximately the same time. Yet another aspect is a system configuration that provides connection between any combination of BSGS gas sources, source container types, and BSGS gas panels, thus eliminating the need for multiple designs/configurations to make use of existing or standard pigtail assemblies, enclosures and gas panels, etc.

Further objects, advantages and embodiments of the invention will become evident from the reading of the following detailed description of the invention wherein reference is made to the accompanying drawings.

BRIEF DESCRIPTION OF THE DRAWINGS

FIG. 4 shows the monitoring of the difference in container net weights as well as individual on-stream containers and the control response of putting the appropriate containers into a standby mode.

FIG. 5 shows the monitoring of the difference in container net weights as well as individual on-stream containers and the control response of adjustment of temperature or pressure set points.

FIG. 6 shows the container weight loss rates being calculated and compared and the control response of putting the appropriate containers into a standby mode.

FIG. 7 shows the monitoring of weight loss rates (as shown in FIG. 6) along with the adjustment of temperature or pressure set points (as shown in FIG. 5).

FIG. 8 shows the monitoring of flow rates from each container with the proportion of flow from each container being calculated along with the adjusting of temperature or pressure set points.

FIG. 9 shows flow being drawn from one container at a time.

DETAILED DESCRIPTION OF THE INVENTION

Figure 1:
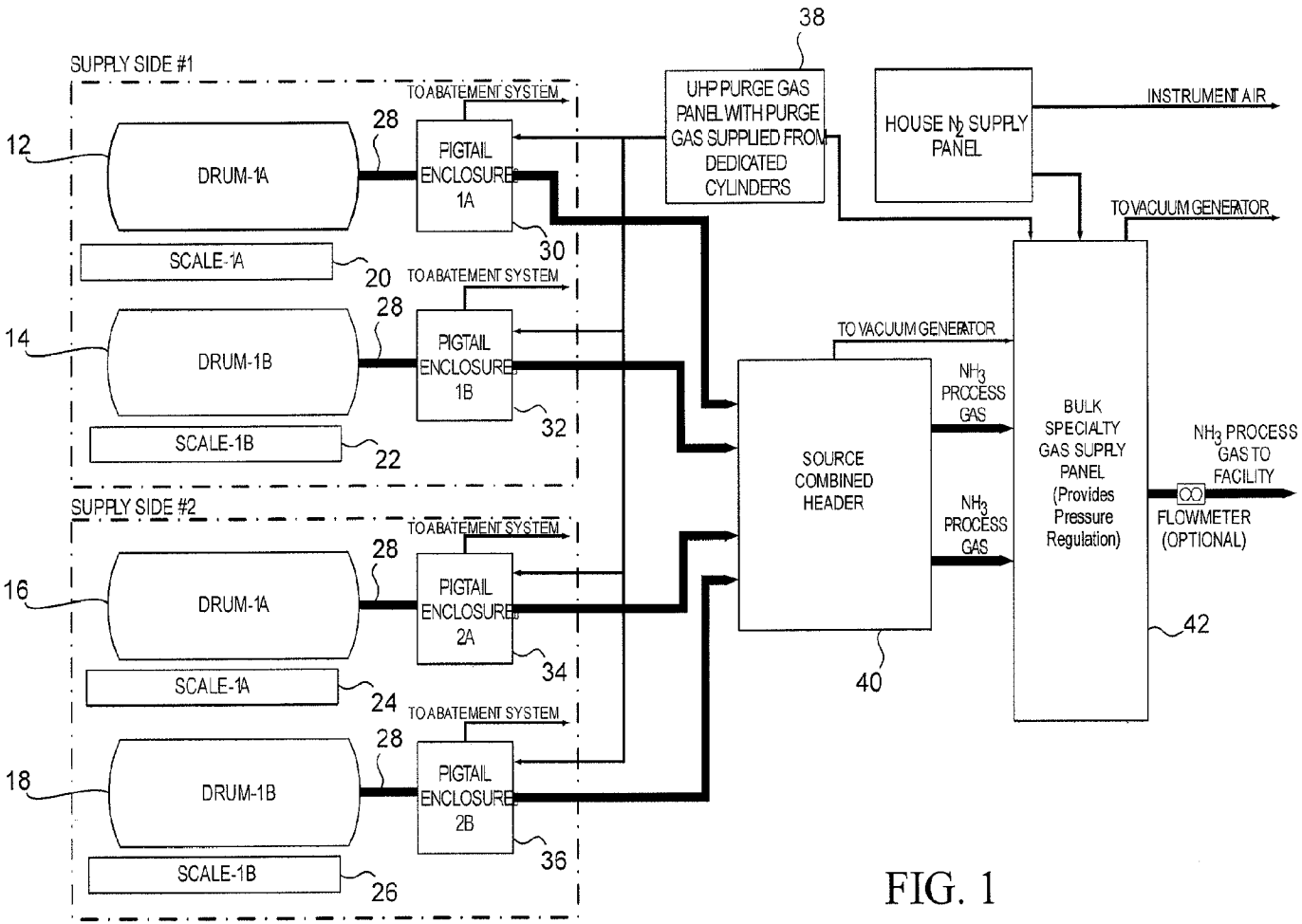
FIG. 1 is a block flow diagram representing a BSGS system, and showing an embodiment of the present invention.

Embodiments of this invention provide the use of at least one universal combined source header that provides a connection between any combination of BSGS gases, BSGS source container types and any downstream BSGS gas panel, thus eliminating the need for multiple redesigns to existing assemblies/enclosures (e.g. pigtail assemblies/enclosures) and/or existing BSGS gas panels.

In addition, embodiments of this invention provide enhanced backflow/backfill detection of the containers. For saturated liquefied gases such as ammonia, backflow may occur from one container to another if the temperatures and pressures of the containers are sufficiently unequal. Backflow is very undesirable, as it can result in overfilling a container with liquid ammonia. This can result in a container becoming hydraulically full, and lead to subsequent over-pressurization of the container when heat is applied. Backflow can also result in liquid ammonia being withdrawn from the container through the vapor line. This is undesired because liquid ammonia preferentially contains moisture and other heavier contaminants. Normally, backflow in such a situation would be prevented by the use of gas-tight check valves. However, such check valves in process gases are generally considered unacceptable in the industries served by ultra-high purity BSGS systems, as they are considered to be significant sources of microscopic particles and other undesirable impurities.

To detect and prevent backflow, in embodiments of the present invention, controls described below detect a trend of increasing weight of the container (weight change rate). If such a trend is detected, the controls will respond with protective measures such as, for example, activating an alarm, shutting down the container that is increasing in weight at an undesirable, pre-selected weight rate or weight range, preferably in concert with adjusting the amount of heat being applied to the containers. The controls also preferably include a (high) weight detection limit for each drum that will activate an alarm and shut down the container, should the weight exceed predetermined limits.

In addition, according to embodiments of the present invention, the vapor withdrawal piping may preferably include substantially all-metal check valves. These valves are not generally considered to be a significant source of particulate contamination in the industries served by BSGS systems. This style of valve does not provide a gas tight seal, but only restricts back flow. Therefore, this type of check valve typically is not a sufficient countermeasure to backflow by itself, but provides additional protection to the weight-based controls. These check valves are preferably, but not necessarily, located in the combined source header.

According to further embodiments, the systems, methods and apparatuses of the present invention deliver substantially automatic equalization with respect to the withdrawal of gas from the containers. Generally, without additional controls, the degree to which multiple containers can substantially simultaneously supply gas at equal flow rates depends on the ability of the multiple containers to maintain equal pressures, and the equality of the flow restrictions in the piping from the containers to the points at which the multiple flows are joined together. Given the difficulty of ensuring that the container pressures are substantially equivalent, and that the flow restrictions of the downstream piping are substantially equivalent, there is a tendency for the flow rate to be unequally distributed among the containers. Embodiments of the present invention provide for the incorporation of controls to ensure that BSGS systems that supply gas substantially simultaneously from multiple containers become depleted at approximately the same time.

According to embodiments of the present invention, many suitable controls may be used to achieve the desired effects, responses and overall system performance. According to one embodiment, the difference in net weights of the containers is monitored by an automatic control system such as a Programmable Logic Controller (PLC). If the difference exceeds a predetermined value, the container with the least weight is temporarily shut down and gas is withdrawn only from the heavier container(s). Once the difference in container weights is within specified limits, the container that was shut down is restarted. If the system senses that the required flow rate is greater than that which may be sustained from the remaining on-stream container(s) when the lighter container has been taken off-stream, then this feature may be temporarily disabled so that flow from the system is not interrupted. For instance, if the supply pressure falls below a predetermined value, then this feature may be temporarily disabled.

In another embodiment, another control strategy for balancing the flows is similar to the control strategy described above, in that the difference in net weights of the containers is monitored by an automatic control system such as a PLC. For this strategy, the control system responds by adjusting the temperature set points of the container heaters based on the difference of the net weights of the containers. In a preferred control strategy, a cascade type control is used in which a container pressure is substantially maintained by a pressure controller which adjusts the heater temperature set point for that container. The pressure set point for one container may be held constant, while the pressure set point for the other container is adjusted, based on the difference in the sensed net weights between the containers. For instance, if container A is lighter than container B, this would indicate that flow is being preferentially drawn from container A. The pressure set point of container A would be reduced by the selected control algorithm to reset and substantially balance the flows from the two containers. If container A weighs more than container B, the opposite action would be taken; the pressure set point of container A would be increased to reset and substantially balance the flows.

Still further, embodiments of present invention contemplate a third control strategy for balancing the flows is to monitor and compare the rate of weight loss of the containers. The results may be used to temporarily shut off one of the containers or to adjust pressure controller set points or heater controller set points.

Another control strategy for balancing the flows contemplated by embodiments of the present invention comprises using a flow meter at the outlet of each container, calculating the ratio of flow from each container, and using the result to either: (1) adjust heater controller set points or (2) adjust pressure controller set points (which may be effected through the use of cascade controlling heater temperature controller set points). In addition, embodiments of the present invention further contemplate the use of dual ISOs that could conceivably use liquid level gauges and transmitter for control purposes, and/or drawing supply from one container at a time, for set time intervals.

An important technical advantage of embodiments of the present invention is that operator intervention generally is not required to ensure that the containers become substantially depleted at approximately the same time. The ability to ensure that the multiple containers that are simultaneously on-stream become simultaneously depleted is a significant economic advantage in that such an improved gas delivery system can greatly reduce the amount of liquefied gas that is wasted as "heel" (the liquefied gas that remains in the container when it is returned to the supplier). The heel is often disposed of by the supplier before refilling. Thus, excess heel not only results in additional cost to the end user, but also can result in excess costs to the supplier due to the need to treat and dispose of the heel, as well as the cost due to the additional time required to remove the excess heel from the container.

According to embodiments of the present invention, the universal combined source header further offers an economic advantage, in that it enables the use of existing pigtail assemblies and BSGS gas panels, (that were originally designed for supplying gas from only a single container at a time), to be used also for systems where gas is substantially simultaneously supplied from multiple containers.

With reference to the block flow diagram shown in FIG. 1, according to preferred embodiments of the present invention, in one system 10, process gas is supplied in transportable drums 12, 14, 16, 18 or other pressurized containers such as "tonners", also known as Y-cylinders, or ISOs. If the gas is a liquefied gas, such as, for example, ammonia, temperature-controlled heaters (not shown) are applied to the containers, and the containers are placed on scales 20, 22, 24, 26. The transportable containers are connected to the system via flexible tubing or hoses 28, that are connected to a corresponding pigtail assembly, located within an air swept pigtail enclosure 30, 32, 34, 36. The pigtail assembly also includes valving, etc., needed for providing purge gas that is required when preparing to connect or disconnect the containers to the system. Gas is typically supplied from one side (i.e. one set of containers) at a time. Gas flows from the containers, through the pigtail assemblies, through the combined source header 40, (where the flows from the multiple containers are joined) and then to the BSGS gas supply panel 42, where the gas pressure is regulated. The gas then leaves the BSGS system and enters various gas distribution devices, such as, for example, distribution valve manifold boxes.

Flexible heating elements (not shown), such as silicone rubber heaters, are attached to the containers to supply the heat of vaporization that is needed to maintain container pressure. Optionally, steel heaters may be utilized with cradles holding ISO containers. These heaters contain temperature sensors for heater and vessel "skin" temperatures, that are used to provide feedback signals for temperature controllers and high temperature shutdown devices. As stated above, the containers are set on weigh scales to monitor system weights. According to embodiments of the present invention, the system is typically monitored/controlled by a PLC system. Discrete temperature controllers are usually used to provide high heater temperature shutdown functions, and may be used to monitor and control the heaters.

When the weigh scales indicate that the containers are depleted, the heaters and valves for a supply side are shut down, and the system automatically switches over to the backup supply, if that side is available. The pigtails for the depleted side then go through a purge sequence, in preparation for removing the depleted container and replacing them with full containers. In this configuration, a dedicated supply of UHP purge gas 38 is supplied to the pigtail assemblies and to the gas panel. The pigtails are vented through the combined source header to a vacuum generator located in the BSGS gas panel 42, or combined heater. Preferably, nitrogen or an inert gas such as helium, or argon is supplied as an instrument air source and to drive a venturi-type vacuum generator. Alternatively, a vacuum pump can be used instead of a venturi-type device.

Figure 2:
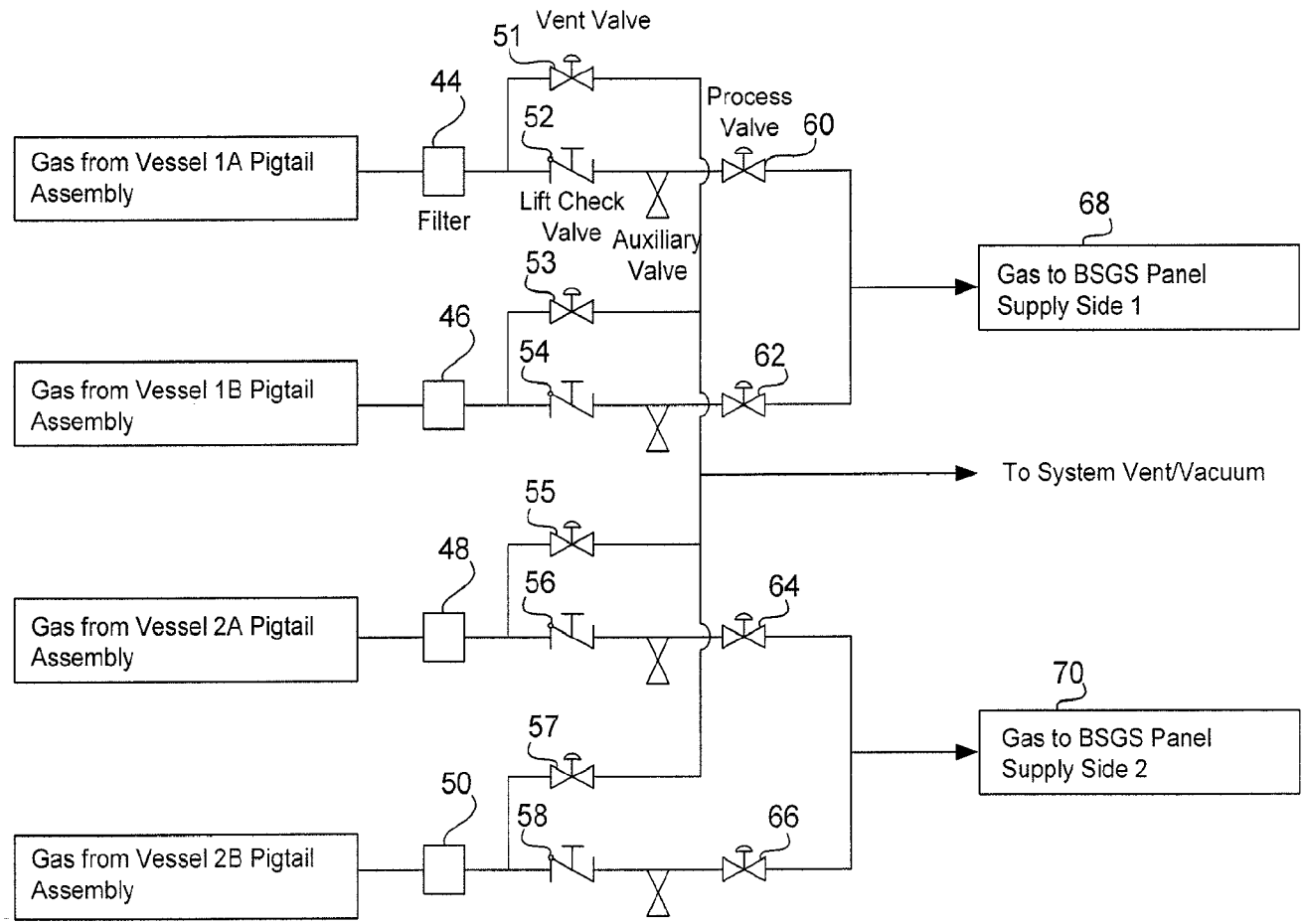
FIG. 2 is a block flow diagram representing an embodiment of the present invention showing a combined source header.

A design of a preferred combined source header, according to embodiments of the present invention, is shown in FIG. 2. In this design, gas is supplied simultaneously from two or more containers to the combined source header. The gas from each source flows first through a filter 44, 46, 48 50, which is used to protect downstream components from solid particulates. The gas then flows through a backflow prevention/minimization device such as a lift check or a UHP grade check valve 52, 54, 56, 58. The gas then flows through an on/off process valve 60, 62, 64, 66, and joins with the flow(s) from the other simultaneously operating gas container(s). The combined flow is sent to the BSGS gas supply panel 68, 70 where the pressure is regulated to the desired pressure. The combined source header includes vent valves 51, 53, 55, 57, that are used to purge the system. Auxiliary valves are used for servicing and maintenance purposes such as helium leak checking or venting the system should a vent valve become unable to open.

Figure 3:
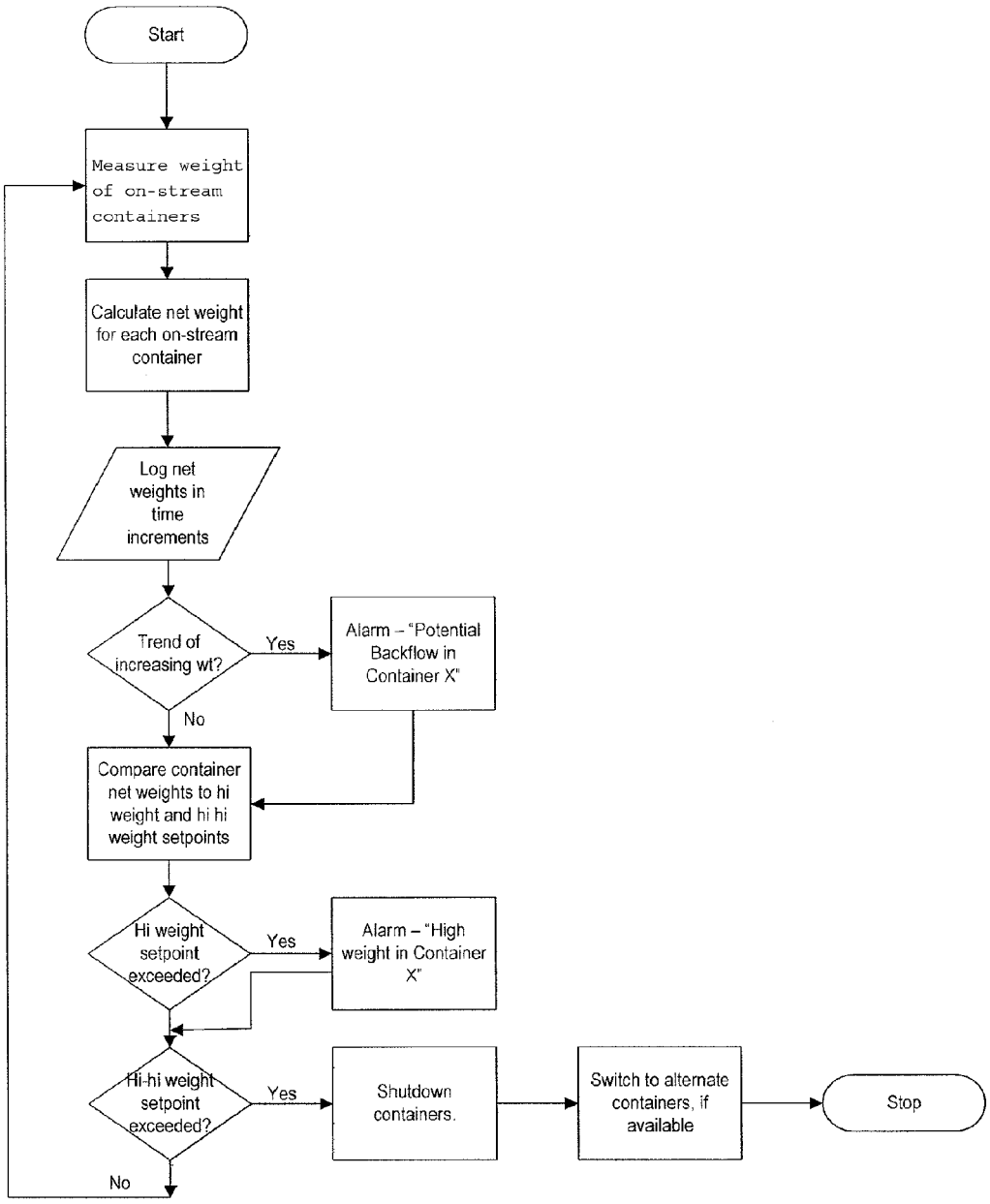
FIG. 3 is a process flow diagram representing an embodiment of the present invention showing the detection of backflow in a multi-container BSGS system.

A process flow diagram for detecting and responding to backflow in a multi-container BSGS system, according to embodiments of the present invention, is shown in FIG. 3. The weights of the individual on-stream containers are continuously monitored. The net weights are calculated and periodically logged. If a trend of increasing weight is detected, an alarm is activated to alert operators and to allow the operators time to make process adjustments. A trend of increasing weight over multiple time increments is used instead of a weight increase of a single time increment to prevent false alarms due to normal events such as personnel placing an object or leaning on a container. If a container exceeds a "high" weight set point, another alarm is activated. If a container exceeds, a "high-high" weight set point, the system preferably performs an automatic switchover to the backup supply.

Figure 4:
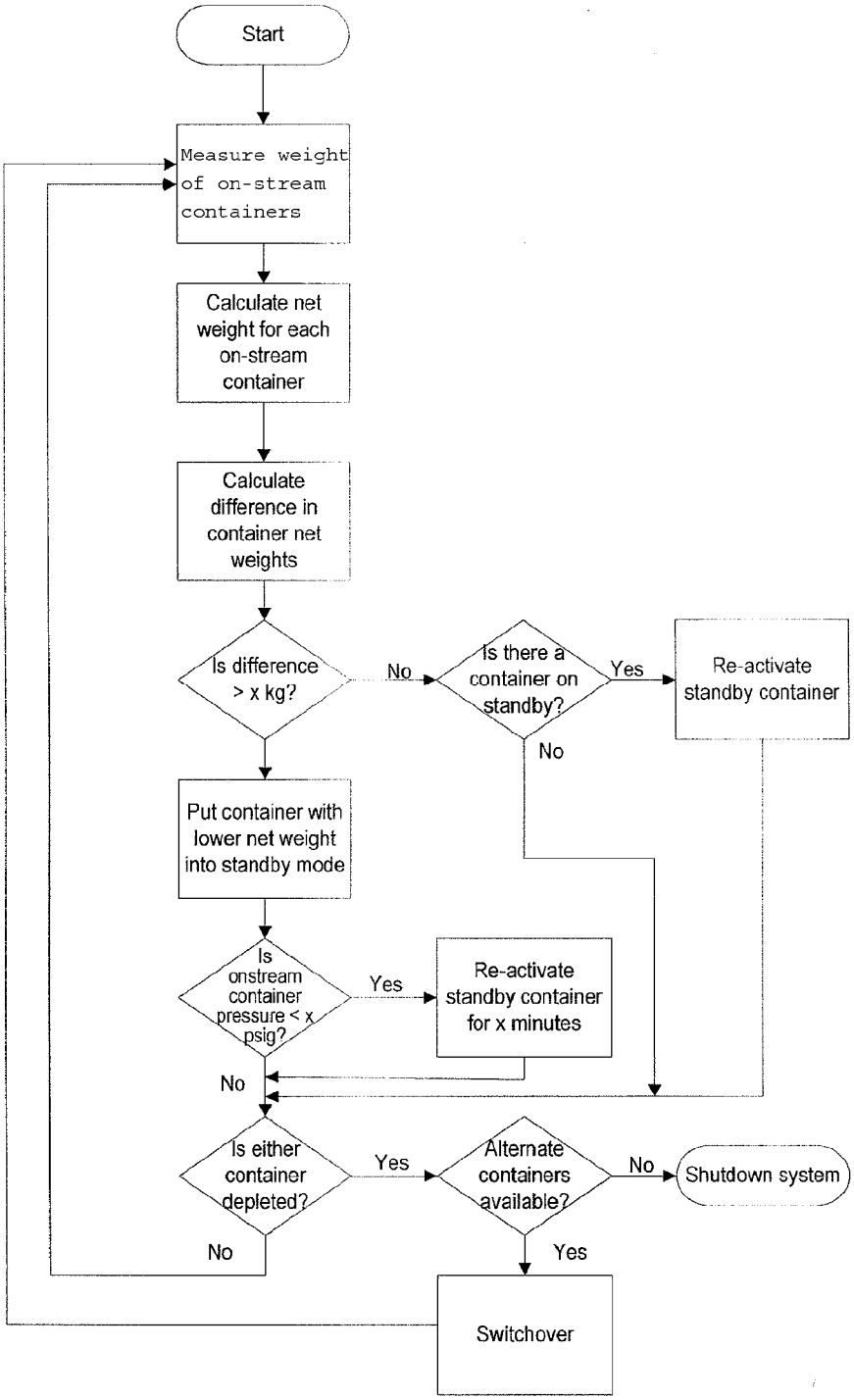
FIGS. 4-9 are flow diagrams of embodiments of the present invention showing the simultaneous depletion of containers.

Process flow diagrams for substantially simultaneously depleting the containers are shown in FIGS. 4-9. In FIG. 4, according to preferred embodiments of the present invention, the weights of the individual on-stream containers are continuously monitored. The net weights of the containers are calculated and compared to each other. If the difference in net weight exceeds a predetermined amount, then the container with the least amount of weight is temporarily taken off-stream automatically, and put into standby mode. If the system is unable to maintain pressure with this container off-stream, then this feature is temporarily disabled.

Figure 5:
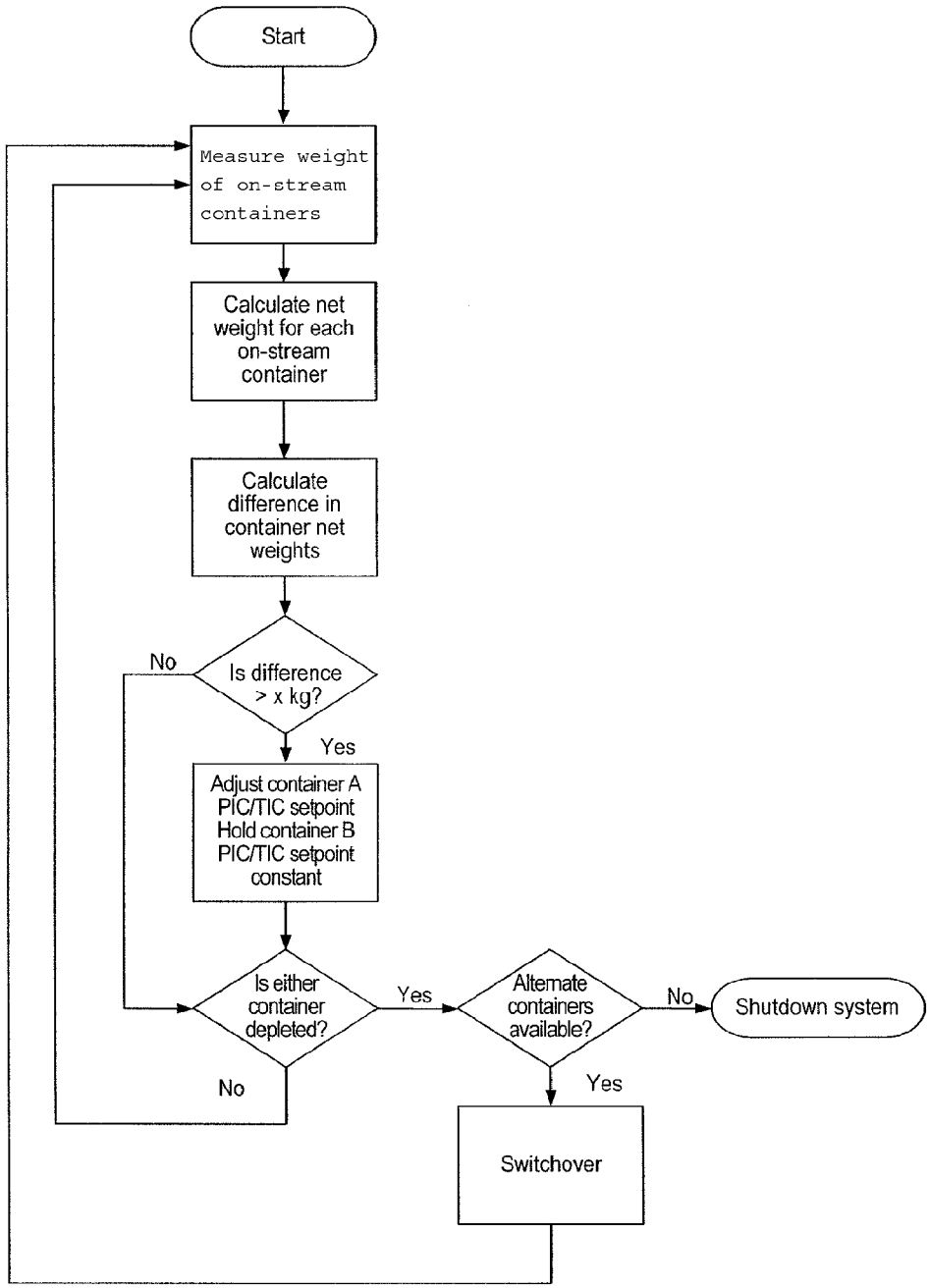

As shown in FIG. 5, the difference in container net weights is also monitored. However, in this control concept, the control response is to adjust the amount of heat being applied to one of the containers either by adjusting the set points of the heater temperature (TIC) controls or by adjusting the pressure set point of a container PIC/TIC cascade control. The set points of the other container are left constant.

Figure 6:
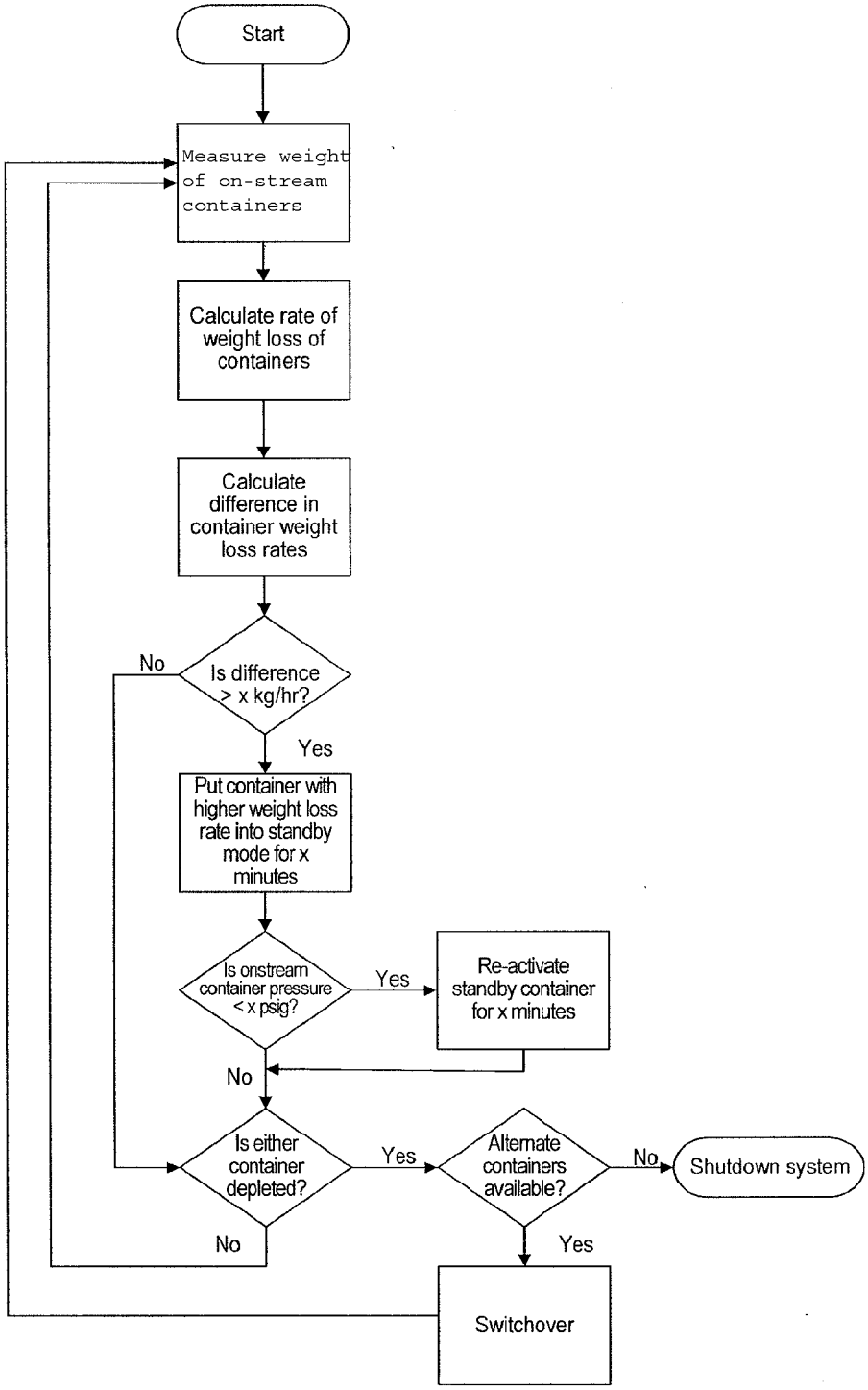

As shown in FIG. 6, the container weight loss rates are calculated and compared. If the difference in weight loss rates exceeds a predetermined amount, the control response is the same as in FIG. 3. The container with the higher weight loss rate is temporarily put into standby mode. If the system is unable to maintain pressure, the system temporarily disables the control that takes the container off stream and, thereby, immobilizes the simultaneous depletion of the containers.

Figure 7:
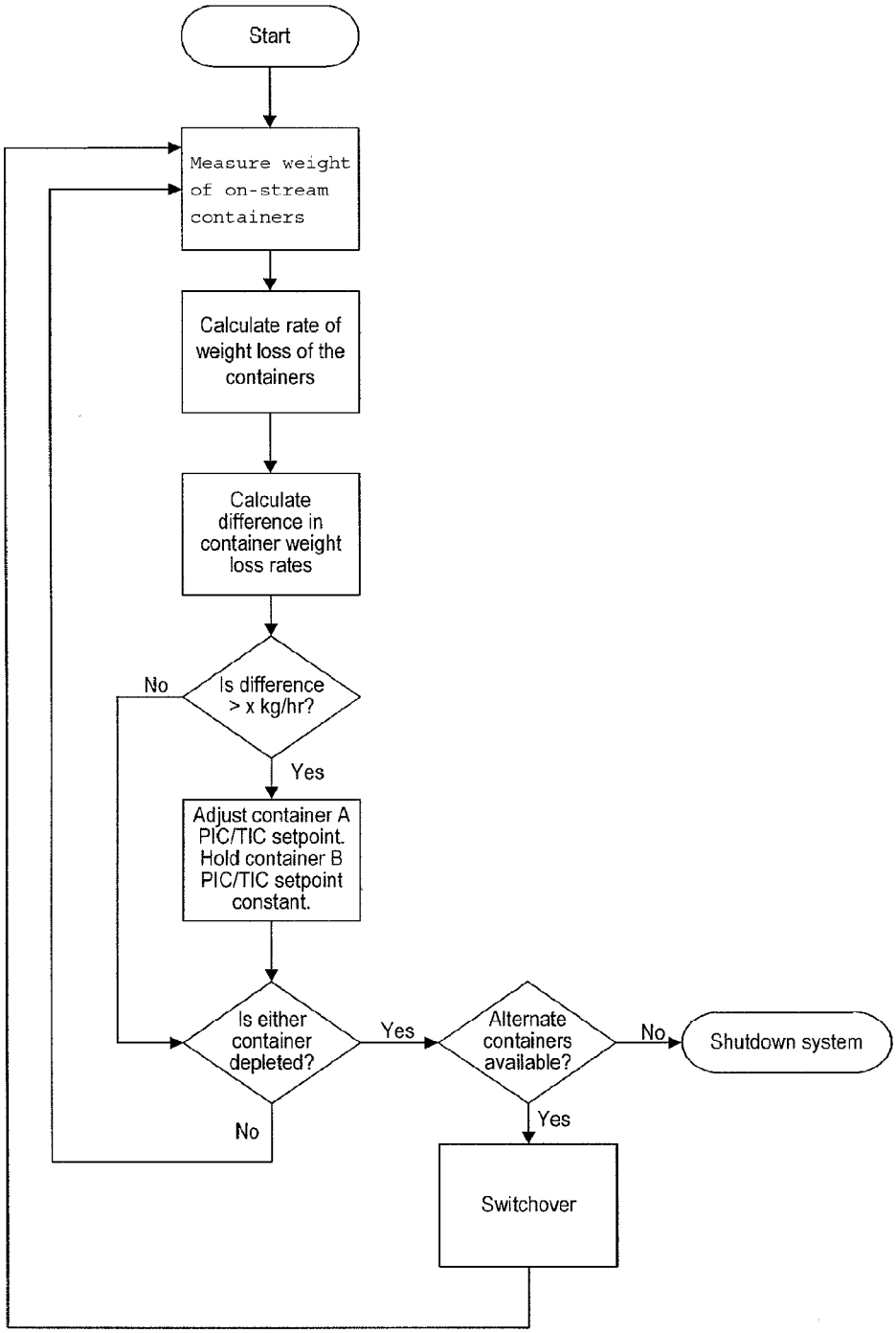

As shown in FIG. 7, the weight loss rates are calculated and compared as is done in FIG. 6. However, the control response is to adjust the temperature or pressure set points as in FIG. 5.

Figure 8:
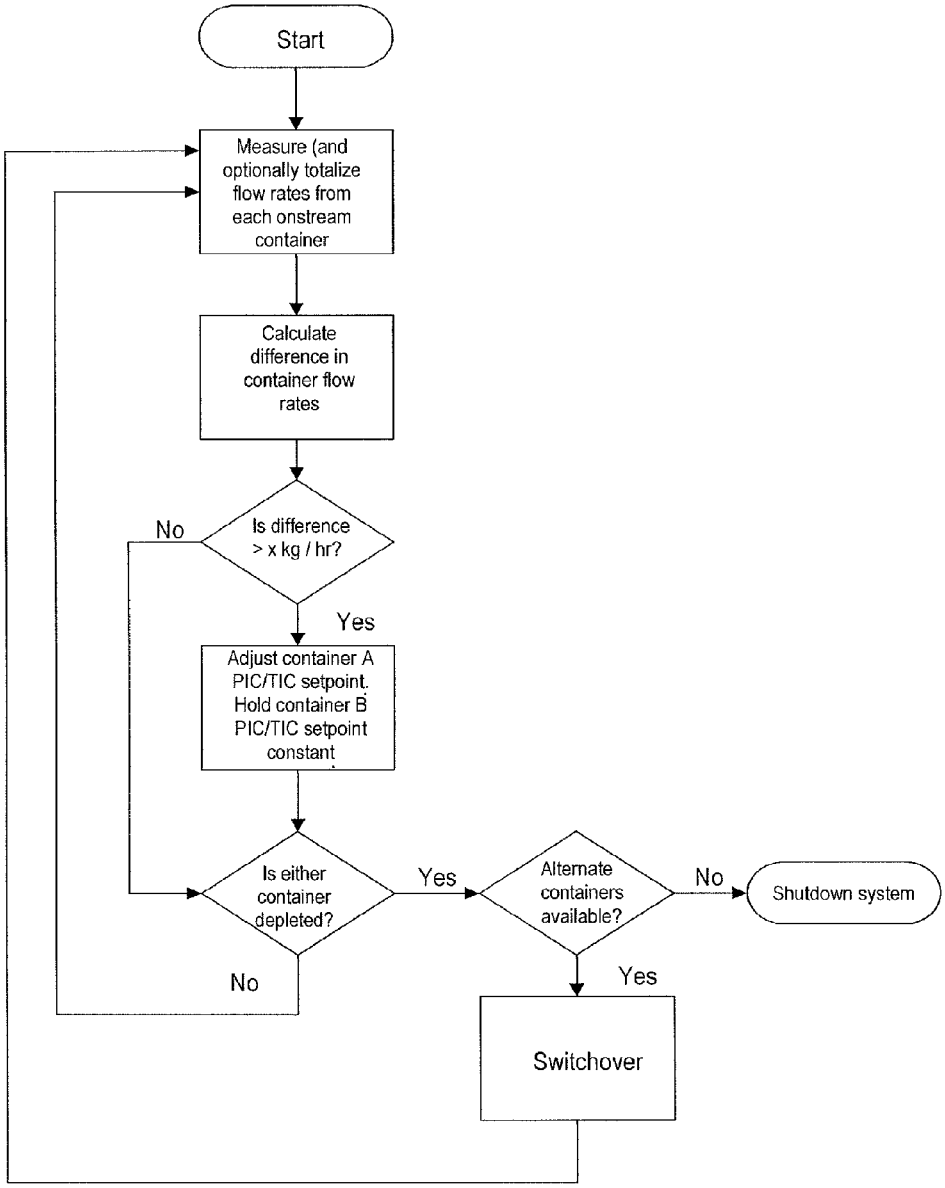

As shown in FIG. 8, according to embodiments of the present invention, flow meters are used to monitor the flow rate from each container. The proportion of flow from each container is calculated. The control response is to adjust the temperature or heater set points as shown in FIGS. 5 and 7.

Figure 9:
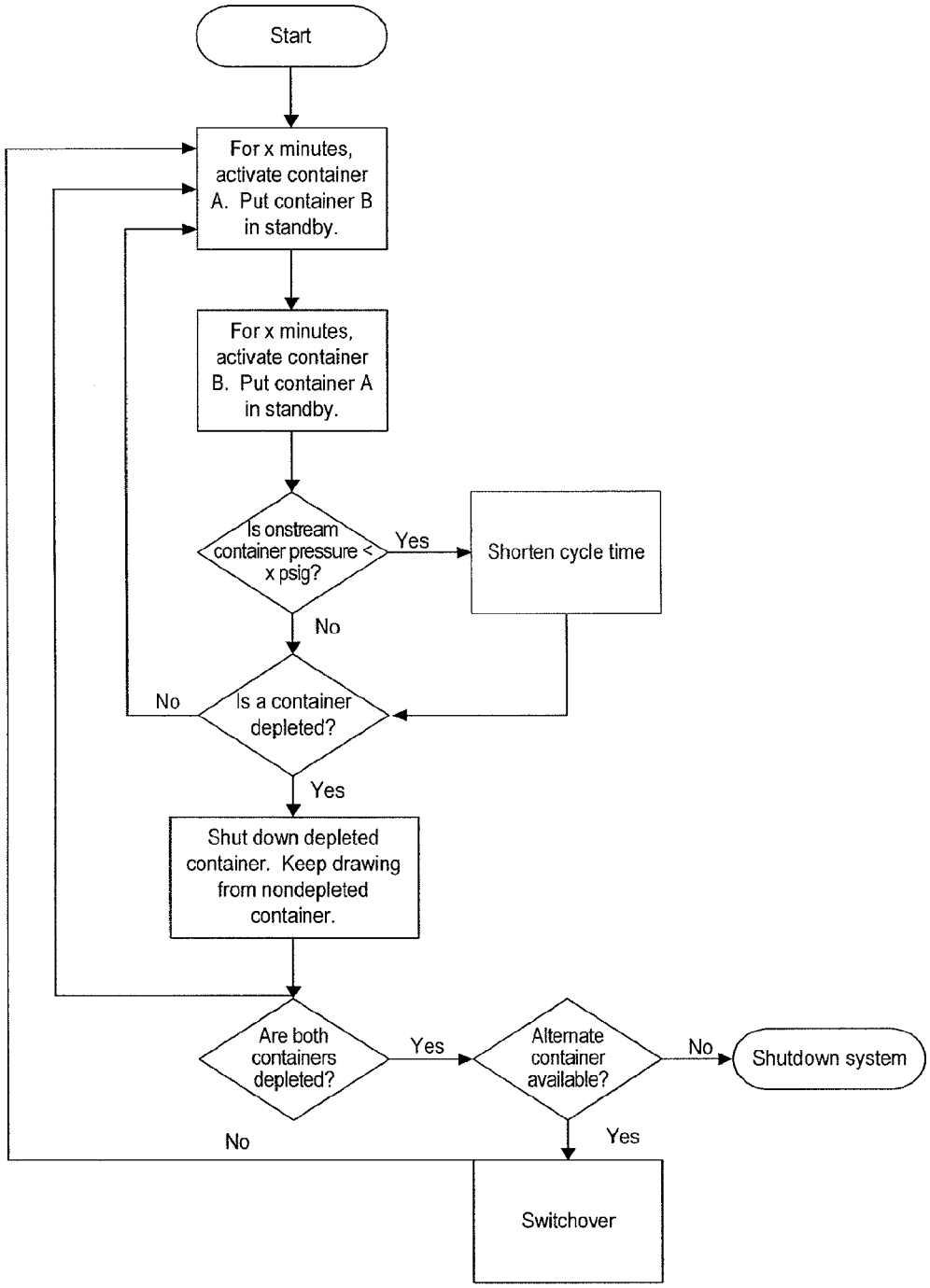

In FIG. 9, according to embodiments of the present invention, the gas flow is drawn from only one container at a time. A relatively short cycle time may be used; on the order of 5-60 minutes may be used. The cycle time may be adjusted as needed to maintain desired supply pressure.

Embodiments of the present invention may be applied to liquefied gases other than ammonia. Some examples of other liquefied gases that may be delivered in BSGS systems include carbon dioxide, hydrogen chloride, hydrogen bromide, nitrous oxide, hydrogen fluoride, etc.

Although the need to prevent backflow is most important with liquefied gases, the invention, consisting of a universal combined source header, a means to prevent backflow, and a means to have simultaneous depletion of the containers, also may be applied to nonliquified gases such as silane and nitrogen trifluoride, etc.

The drawings primarily illustrate the use of two substantially simultaneously operating containers. However any number of substantially simultaneously operating containers may be used. The multiple flows may be accommodated by adding inlets to the combined source header, or by using multiple combined source headers. In some cases, it may even be desired to use dissimilar containers or container types. For example, on one side, the container may be an ISO, but the other side may be multiple low pressure drums.

Additionally, an alternative way to balance the flows from the two containers is to use a continuously adjustable diverter or three way valve.

If a temporary increase in flow rate is desired, (and this flow rate is greater than the capacity of the operating containers), one or more of the containers in standby mode may be activated. This mode of operation would have to include controls to prevent a situation where all the containers in the system become depleted at the same time, or where the standby containers do not have enough inventory to provide gas while the other containers are being changed.

According to embodiments of the invention, all of the pigtails of a "supply side" are allowed to be substantially simultaneously purged. However, the invention also includes the option to allow one or more container(s) of a side to be left operating, while the other container(s) of the same side may be off-stream for purging, container change-out, or maintenance, etc. In addition, the present invention further contemplates the inclusion of a plurality of containers (preferably at least three or four containers or more) and container types (in excess of two container types). For example, as stated above, the present invention contemplates the use of the present system for ammonia delivery comprising a heated ammonia ISO, preferably having a capacity of about 20,000 liters on one side of the BSGS system and three or four drum containers in parallel on the opposite side of the system. In one contemplated embodiment, the drum containers would be used predominantly during the period of time when a substantially empty or nearly empty ISO container is being exchanged for a full ISO.

While the present invention has been described in detail with reference to specific embodiments thereof, it will be apparent to one skilled in the field that various changes, modifications, and substitutions can be made, and equivalents employed without departing from, and are intended to be included within, the scope of the claims.

We claim:

1. A method for supplying gas from a multi-container system comprising the steps of:

providing a multi-container system comprising at least a first and second container;

monitoring individual weights of at least the first and second containers over multiple time increments;

generating a real-time profile for each of the individual weights of at least the first and the second containers;

determining whether the profile exhibits a trend of increasing weight over multiple time increments in at least one of the first or second containers that exceed a first predetermined set point or a second predetermined set point greater than the first predetermined set point;

generating a first alarm when the trend of one of the profiles exceed the first predetermined set point;

generating a second alarm when the trend of one of the profiles exceed the second predetermined set point and switching to the other container in response to the second alarm;

whereby overfilling of at least the first or second container without operator intervention is prevented by intermittently switching between the first container and the second container, wherein the first container is an on-stream container and the second container is a backup supply container.

2. An apparatus for supplying gas from a multi-container system comprising:

a multi-container system comprising a plurality of onstream containers and a plurality of backup supply containers, the onstream and the backup supply containers placed on scales;

an enhanced backflow/backfill control system configured for monitoring and regulating at least one process parameter of each of the plurality of containers, said parameter selected from the group consisting of pressure, flow rate, temperature, liquid level and container weight, said control system in communication with each of the plurality of onstream and backup supply containers, said control system configured to detect and prevent overfilling and equalize withdrawal of gas from the onstream containers without operator intervention by intermittently switching between the onstream and the backup supply containers; and a single combined source header configured to simultaneously receive gas from each of the containers and supply a combined gas stream downstream to one or more bulk specialty gas supply systems.

3. The apparatus of claim 2, wherein the at least first and second containers contain liquefied gas.

4. The apparatus of claim 2, wherein the gas is selected from the group consisting of ammonia, carbon dioxide, hydrogen chloride, hydrogen bromide, hydrogen fluoride, nitrous oxide.

5. The apparatus of claim 2, wherein the control system is configured to detect a trend of increasing container weight.

6. The apparatus of claim 2, wherein the control system is configured to detect the rate at which weight changes in each container.

7. The apparatus of claim 5, wherein the control system is configured to compare individual weights of the onstream containers with a weight detection limit prior to switching to the backup supply containers.

8. The apparatus of claim 2, wherein the multi-container system comprises vapor withdrawal connections comprising metal check valves.

9. The apparatus of claim 2, wherein the system further comprises one or more bulk specialty gas supply systems.

10. A method for equalizing the withdrawal of gas from a multi-container system comprising the steps of:

providing a multi-container system comprising at least a first container and a second container;

withdrawing gas from the first container at a first flow rate and the second container at a second flow rate;

monitoring a first process parameter of the first container;

monitoring a second process parameter of the second container;

determining a difference between the first monitored process parameter and the second monitored process parameter; and adjusting a third process parameter of the first container or a fourth process parameter of the second container in response to the difference between the first and the second monitored process parameters to achieve depletion of gas from the first and the second containers at substantially the same time by intermittently switching between the first and the second containers when the difference is greater than a predetermined value, whereby the first, second, third and fourth process parameters is selected from the group consisting of pressure, flow rate, temperature, liquid level, rate of container weight loss and container weight.

11. The method of claim 10, wherein the third process parameter is flow rate of gas withdrawn from the first container and the fourth process parameter is flow rate of gas withdrawn from the second container, and further wherein the step of adjusting comprises reducing the third or the fourth process parameter to zero in response to the difference between the first and the second process parameters exceeding a predetermined value.

12. The method of claim 11, further comprising the step of re-activating one of the reduced flow rates of gas in response to the difference between the first and the second process parameters being within the predetermined value.

13. The method of claim 10, wherein the step of adjusting one of the third or fourth process parameters comprises adjusting a set point of the third process parameter or the fourth process parameter to substantially balance the first flow rate and the second flow rate.

14. The method of claim 11, wherein the first process parameter is the first rate of weight loss from the first container and the second process parameter is the second rate of weight loss from the second container.

15. The method of claim 10, wherein the first process parameter is the first flow rate and the second process parameter is the second flow rate, the third process parameter is pressure or temperature and the fourth process parameter is pressure or temperature, wherein the set point of the third or fourth process parameter is adjusted in response to the difference between the first and the second process parameters.

16. The method of claim 10, wherein the first process parameter is the first container weight and the second process parameters is the second container weight, the third process parameter is pressure or temperature and the fourth process parameter is pressure or temperature, wherein the set point of the third or fourth process parameter is adjusted in response to the difference between the first and the second process parameters.

17. The method of claim 14, wherein the set point of the third or fourth process parameter is adjusted in response to the difference between the first and the second process parameters.

18. The method of claim 1, further comprising comparing the individual weights with the first and the second predetermined set points.

19. The method of claim 1, further comprising the step of withdrawing gas from at least the first and second containers at substantially equal flow rates.

20. The method of claim 1, further comprising the steps of:

withdrawing gas from one of the first and the second containers for a predetermined time until the first or the second alarm is generated or until gas is depleted from the container.

* * * * *